US006041609A

United States Patent [19]

Hornsleth et al.

[11] Patent Number: 6,041,609

[45] Date of Patent: Mar. 28, 2000

[54] COMPRESSOR WITH CONTROL ELECTRONICS

[75] Inventors: Steen Hornsleth; Jens Simonsen, both of Nordborg; Jørgen Holst, Sydals, all of Denmark

[73] Assignee: Danfoss A/S, Nordborg, Denmark

[21] Appl. No.: 08/981,704

[22] PCT Filed: Jul. 3, 1996

[86] PCT No.: PCT/DK96/00300

§ 371 Date: Apr. 21, 1998

§ 102(e) Date: Apr. 21, 1998

[87] PCT Pub. No.: WO97/02729

PCT Pub. Date: Jan. 23, 1997

[30] Foreign Application Priority Data

Jul. 6, 1995 [DK] Denmark ..... 0795/95

[51] Int. Cl.[7] ..... H05K 7/20; F25B 41/00

[52] U.S. Cl. ..... 62/259.2; 62/505

[58] Field of Search ..... 62/505, 513, 259.2

[56] References Cited

U.S. PATENT DOCUMENTS

| | | | |
|---|---|---|---|
| 3,903,710 | 9/1975 | Quatman | 62/513 |
| 4,047,242 | 9/1977 | Jakob et al. | 361/389 |
| 4,720,981 | 1/1988 | Helt et al. | 62/113 |
| 5,012,656 | 5/1991 | Tamura | 62/498 |
| 5,220,809 | 6/1993 | Voss | 62/259.2 |
| 5,350,039 | 9/1994 | Voss et al. | 184/6.16 |

*Primary Examiner*—William Doerrler
*Attorney, Agent, or Firm*—Lee, Mann, Smith, McWilliams, Sweeney & Ohlson

[57] ABSTRACT

The invention concerns a hermetic cooling compressor with an electric motor having a variable speed controlled by a converter cooled by a cooling medium flow. The compressor and the converter are formed together as a unit, in which a medium flowing through the unit is used for cooling of the electronic circuit of the converter. Thus the electronic circuit can be made without bulky cooling plates.

7 Claims, 2 Drawing Sheets

COMPRESSOR WITH CONTROL ELECTRONICS

Figure 1:
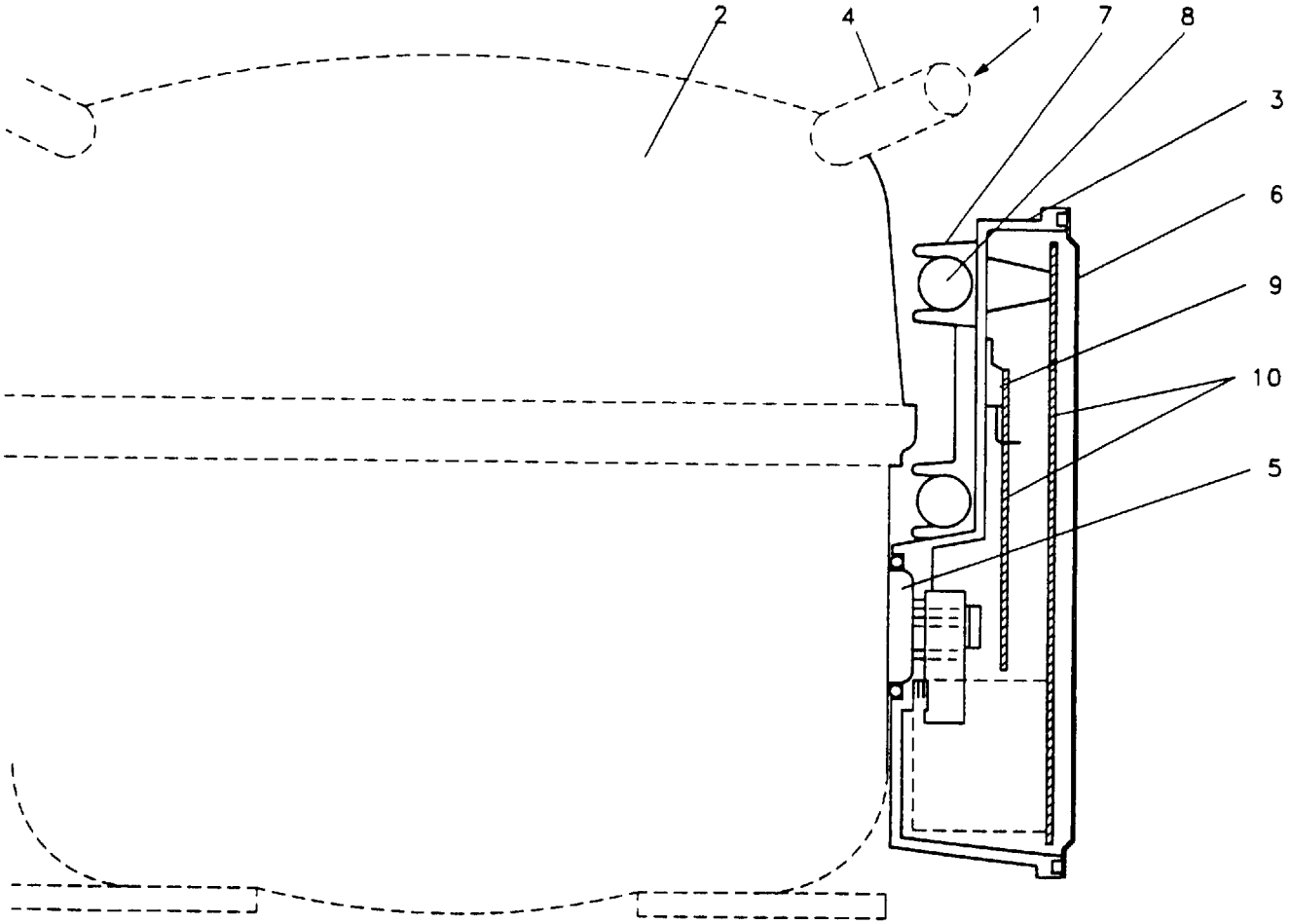

The invention concerns a hermetic cooling compressor with an electric motor having a variable speed controlled by a converter cooled by a cooling medium flow.

From U.S. Pat. No. 4,720,981 it is known to cool control electronics for a compressor with cooling medium by letting the fluid between capacitor and evaporator flow through a cooling plate.

This will keep the temperature of the cooling plate constant, as the fluid flow can cool or heat as required.

U.S. Pat. No. 5,220,809 describes the cooling of system electronics for automobile air-conditioning, in which the cooling medium is led to a cooling block, on which the system electronics unit is mounted, in parallel with throttling device and evaporator. The cooling block has its own throttling device at the inlet, and the outlet is connected to the suction pipe of the compressor. The cooling block acts as an evaporator connected in parallel.

U.S. Pat. No. 5,012,656 describes how electronic components are fixed to the outside of an evaporator, through the inside of which the air to be cooled is flowing, before it is led to the inside of the car.

In all three described methods for cooling the electronic unit will be placed relatively far from the cooling compressor. This will involve the use of long cables with a great risk of radiated interference disturbing the surroundings. The electronic circuit will be cooled by gas having approximately the same temperature as the surroundings. Thus the electronic components will have a high operation temperature, resulting in a reduced lifetime.

The purpose of the invention is to present cooling of an electronic circuit, which is built together with a hermetic compressor.

The task set can be solved by means of a cooling compressor as described in the introduction, if compressor and converter are built together in one unit, in which a medium flowing through said unit is used for the cooling of the electronic circuit of the converter.

This will give a compact design, in which the size of the electronic circuit is determined by the components and not by demands for cooling plates for the cooling of power electronics. Simultaneously, forced air cooling can be avoided. A cable between control electronics and compressor can be completely avoided by direct connection to the connection terminals of the compressor. Thus high frequency interference can be eliminated efficiently.

The invention can be realised through utilisation of the suction gas of the compressor for cooling of the electronic circuit. This will cause a low working temperature for the electronic circuit, thus increasing the lifetime of the electronic components.

The oil of the compressor can be used for cooling of the electronic circuit. This will give an efficient cooling, which also helps increasing the oil temperature in order to avoid absorption of the cooling medium. Future compressors will be energy-optimised to a degree, which will prevent them from reaching an ideal oil temperature during normal operation.

The electronic circuit can be mounted on a heat conducting plate having a heat conducting connection with the compressor shell, cooled with oil inside the compressor. Thus a good distribution of the induced heat to the whole compressor housing is obtained, said compressor housing thus acting as common cooling plate.

The electronic circuit can be mounted on a heat conducting plate having a heat conducting connection to the compressor shell in an area, in which the compressor shell is cooled by the entry of the suction pipe branch. This results in cooling with suction gas without interference with the suction gas connection.

The electronic circuit can be mounted externally on the compressor in connection with a cable entry of the compressor shell, where the electronic circuit is mounted on a heat conducting plate having a channel through which cooling medium is flowing. This gives a cooling to approximately the same temperature as that of the evaporator.

With advantage, the electronic circuit can control the superheating of the suction gas in dependence of the temperature of the power electronics. If the cooling system has an electronically controlled expansion valve, said valve can control the superheating in a way that the electronic unit gets an improved cooling. This will cause stable operation of the cooling system, even at extremely high ambient temperatures, which may exist in the engine room of a car.

In the following the invention is explained on the basis of drawings, where

Figure 2:
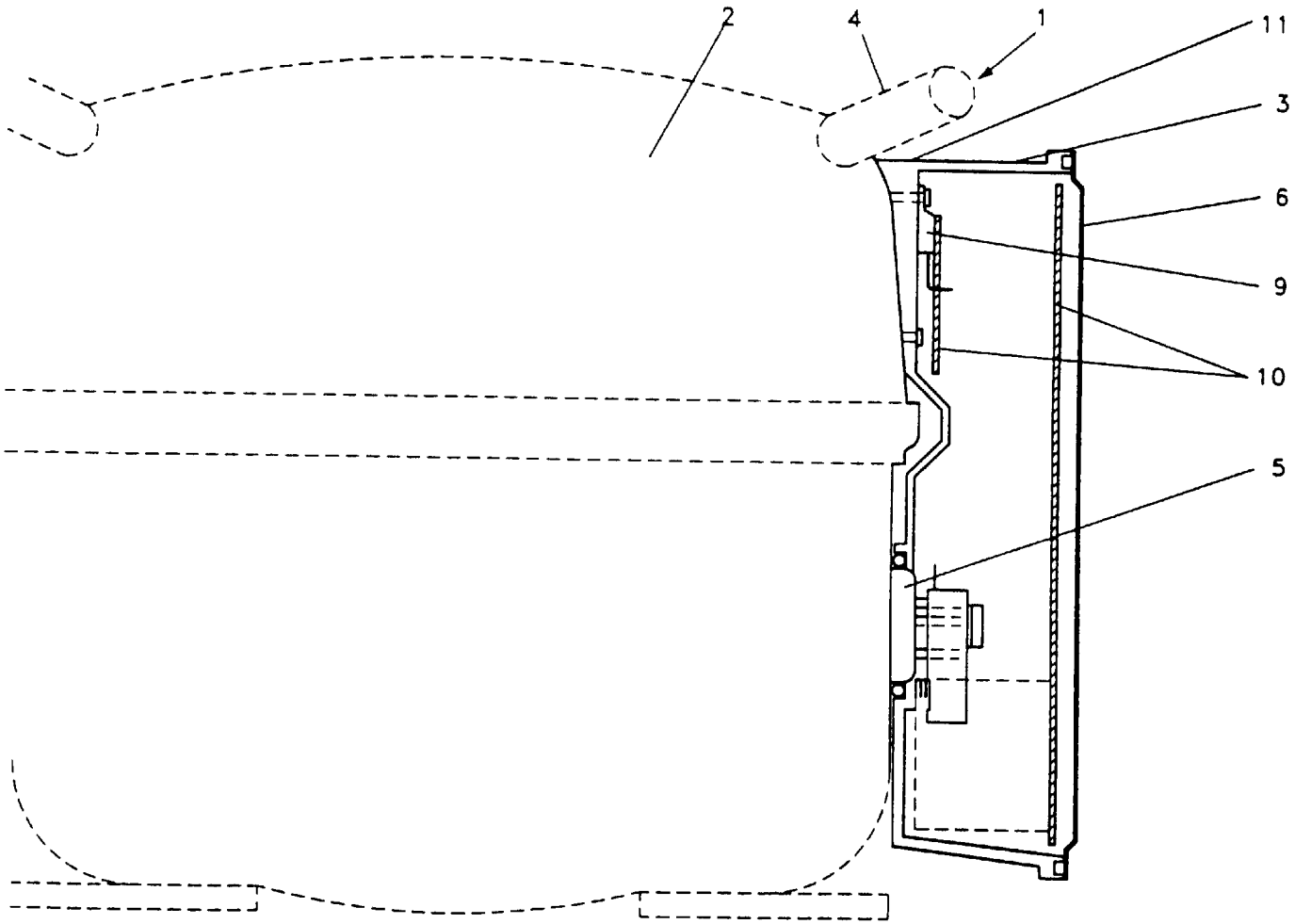

FIG. 1 shows the invention using the suction gas for cooling of power components, and FIG. 2 shows a design, in which the compressor shell is used for cooling FIG. 1 shows a unit 1, built together of a cooling compressor 2 and an electronic unit 3. On the cooling compressor 2, a suction pipe branch 4 and a plug for electrical entry 5 are shown. The electronic unit 3 is enclosed in a housing 6, said housing 6 having heat conducting connection to the cooling plate 7, in which there is a channel for suction gas 8. The channel can be made as suggested here by means of a pipe running in grooves in the cooling plate 7, or the cooling plate 7 can be made with channels with an inlet and an outlet for suction gas. Inside the electronic unit 3 power electronics 9 with good heat conducting connection to the cooling plate 7 are shown. The figure also shows printed circuit boards 10, on which the remaining part of the electronic circuit are placed.

The electronic unit 3 consists of a converter for conversion of the mains frequency to a variable frequency, or a converter converting a DC-supply to an AC-supply to the motor. The most efficient thing to do could be to use a three-phase motor and thus a three-phase control for said motor. The power electronic components required for the control of the motor deposit a relatively large power. Therefore, these components must have an efficient cooling. The components are cooled through heat conducting connections direct from the component to a cooling plate cooled by the suction gas, said suction gas of the compressor being assumed to have approximately the same temperature as the evaporator.

The electronic control unit can also control the injection valve of the evaporator. This enables the securing of the required cooling of the power components via the control electronics by regulating the injection valve and thus the superheating of the gas sucked through the cooling system by the compressor. At automobile air-conditioning extremely high temperatures may occur, if compressor and control electronics are placed in a motor room.

FIG. 2 shows an alternative design of the invention, differing by the fact that part of the electronics housing 11 is formed with a profile adapted to the outside of the compressor. Thus the lubricating oil of the compressor is used for cooling of the power electronics 9, as the inner wall of the compressor is constantly sprinkled with oil. The fact that the electronic unit 3 is mounted on the compressor near the suction pipe branch 4 will cause the suction gas to have a cooling effect on the compressor wall in an area near the pipe branch. Thus the power electronics components can be held at a temperature which is lower than the oil temperature.

We claim:

1. Hermetic cooling compressor with an electric motor having a variable speed and being controlled by a converter cooled by a cooling medium flow, the converter comprising a housing and an electronic circuit, the converter being mounted on an exterior surface of a shell of the compressor, the compressor and the converter being connected together in one unit, in which a medium flowing in said unit is used for cooling of the electronic circuit of the converter.

2. Hermetic cooling compressor according to claim 1, in which suction gas of the compressor is used for cooling of the electronic circuit.

3. Hermetic cooling compressor according to claim 1, in which oil of the compressor is used for cooling of the electronic circuit.

4. Hermetic cooling compressor according to claim 1, in which the electronic circuit is mounted on a heat conducting plate having a heat conducting connection to the shell of the compressor, the shell being cooled with oil inside the compressor.

5. Hermetic cooling compressor according to claim 1, in which the electronic circuit is mounted on a heat conducting plate having a heat conducting connection to the shell of the compressor in an area in which the compressor shell is cooled by entry of a suction pipe branch.

6. Hermetic cooling compressor according to claim 1, in which the electronic circuit is mounted on the outside shell of the compressor in connection with a plug entry through the compressor shell, said electronic circuit being mounted on a heat conducting plate having a channel through which cooling medium flows.

7. Hermetic cooling compressor according to claim 1, in which the electronic circuit controls the superheating of the suction gas in dependence of the temperature of power electronics located in the converter.

* * * * *